US009022096B2

(12) United States Patent
Eshelman et al.

(10) Patent No.: US 9,022,096 B2
(45) Date of Patent: May 5, 2015

(54) TOWER PUMP CASTING APPARATUS

(71) Applicants: Larry Joe Eshelman, Norris, TN (US); Edna Marie Eshelman, Norris, TN (US)

(72) Inventors: Larry Joe Eshelman, Norris, TN (US); Edna Marie Eshelman, Norris, TN (US)

( * ) Notice: Subject to any disclaimer, the term of this patent is extended or adjusted under 35 U.S.C. 154(b) by 0 days.

(21) Appl. No.: 14/089,060

(22) Filed: Nov. 25, 2013

(65) Prior Publication Data

US 2014/0166230 A1 Jun. 19, 2014

Related U.S. Application Data

(60) Provisional application No. 61/736,922, filed on Dec. 13, 2012.

(51) Int. Cl.

| | |
|---|---|
| ***B22D 35/00*** | (2006.01) |
| ***B22D 25/02*** | (2006.01) |
| ***B22D 11/06*** | (2006.01) |

(52) U.S. Cl.
CPC ..... *B22D 25/02* (2013.01); *B22D 11/0611* (2013.01)

(58) Field of Classification Search
USPC ..... 164/259, 335; 266/207, 236
See application file for complete search history.

(56) References Cited

U.S. PATENT DOCUMENTS

| | | | | |
|---|---|---|---|---|
| 3,926,247 | A | 12/1975 | Geiger et al. | |
| 4,014,529 | A * | 3/1977 | Puzhailo et al. | 266/210 |
| 5,191,929 | A * | 3/1993 | Kubota et al. | 164/500 |
| 5,913,358 | A * | 6/1999 | Chadwick | 164/457 |
| 6,451,246 | B2 * | 9/2002 | Hatano et al. | 266/94 |
| 7,270,781 | B2 | 9/2007 | Yamamoto et al. | |
| 2008/0314548 | A1 * | 12/2008 | Cooper | 164/136 |

* cited by examiner

*Primary Examiner* — Kevin P Kerns

(57) ABSTRACT

A casting apparatus having a main chamber connected to at least one casting tower. The main chamber may contain molten metal and the temperature within the main chamber may be maintained by a furnace. A pump may pump the molten metal up the tower and into an upper pool chamber. A feeder nozzle may feed the molten metal from the upper pool chamber and onto a chilling wheel, which may turn the molten metal into metal flakes.

16 Claims, 3 Drawing Sheets

TOWER PUMP CASTING APPARATUS

CROSS-REFERENCE TO RELATED APPLICATION

This application claims the benefit of priority of U.S. provisional application No. 61/736,922, filed Dec. 13, 2012, the contents of which are herein incorporated by reference.

BACKGROUND OF THE INVENTION

The present invention relates to casting apparatus and, more particularly, to a casting apparatus with a tower pump for elevating and releasing molten metal.

Casting is a manufacturing process by which a liquid material is usually poured from a chamber. To create metal flakes, the molten metal may be poured on a chiller wheel. Current systems of creating metal flakes are inefficient and expansive. The capacity of the devices that contain the liquid metal and the dispensing of the liquid metal are mismatched, causing disruptions in the process flow and thereby decreases production.

As can be seen, there is a need for an improved device used for casting.

SUMMARY OF THE INVENTION

In one aspect of the present invention, a casting apparatus comprises: a main chamber formed to contain a molten metal; a tower having a top end and a bottom end and comprising an upper pool chamber near the top end, wherein the main chamber feeds into the tower; a pump configured to pump the molten metal from the bottom end of the tower to the upper pool chamber; and a feeder nozzle connected to the upper pool chamber, and configured to dispense the molten metal out of the upper pool chamber.

These and other features, aspects and advantages of the present invention will become better understood with reference to the following drawings, description and claims.

DETAILED DESCRIPTION OF THE INVENTION

Figure 1:
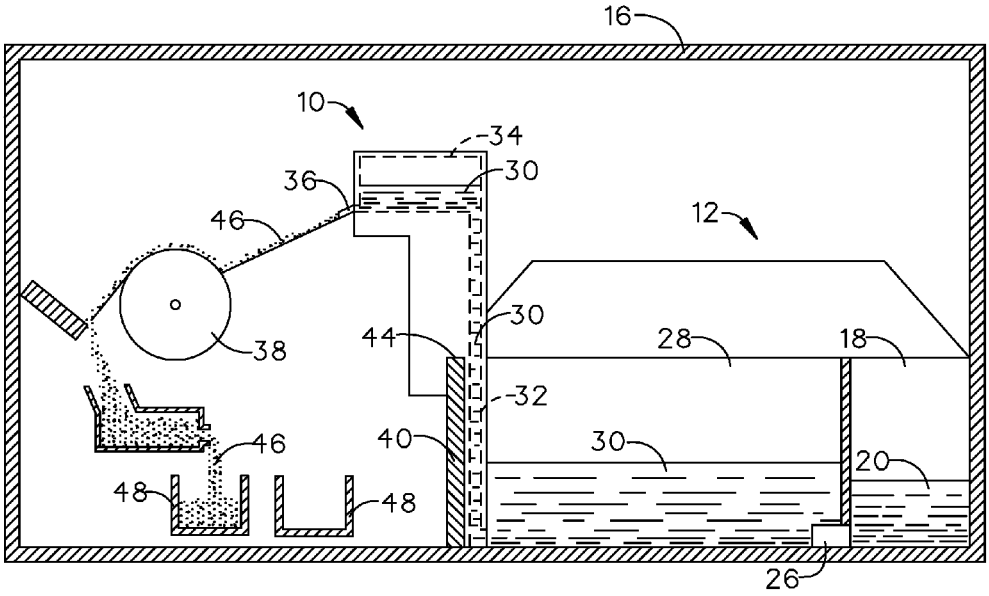
FIG. 1 is a schematic view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a casting apparatus having a main chamber connected to at least one casting tower. The main chamber may contain molten metal and the temperature within the main chamber may be maintained by a furnace. A pump may pump the molten metal up the tower and into an upper pool chamber. A feeder nozzle may feed the molten metal from the upper pool chamber and onto a cooling wheel, which may turn the molten metal into metal flakes.

The present invention may include a pump and tower assembly that elevates a flowing column of a fluid to gravity fed stations. In particular, the present invention may be implemented as a casting apparatus. In certain embodiments, the present invention may be gas enclosed as opposed to a heavy and bulky vacuum chamber. In certain embodiments, a single alloy furnace may accommodate multiple casters. The alloy furnace may be recharged through a charging port using a static mixer. The inert gas enclosure is simple and inexpensive to maintain. The present invention may eliminate an extra chilling and melting cycle from the process.

The casters may be interchangeable and may contain the same moving parts. The interchangeable casters may be taken off the line for easy repair and maintenance and a backup caster may be quickly installed. Using the interchangeable pump and tower assemblies of the present invention, the casting and chilling stations may match the capacity of the furnace for a quicker and more efficient casting process. With the system of interchangeable components, the time to repair and replace may be drastically reduced and production may be increased as a result.

Referring to FIGS. 1 through 5, the present invention may include a casting apparatus. The casting apparatus may include a main chamber 28. The main chamber 28 may contain a molten metal 30, such as molten alloy 30. The casting apparatus may further include a tower 10 having a top end and a bottom end. The top end may include an upper pool chamber 34. The main chamber 28 may feed into the tower 10. The present invention may further include a pump 32 that may pump the molten metal 30 up the tower 10 and into the upper pool chamber 34. A feeder nozzle 36 may feed the molten metal 30 from the upper pool chamber 34 and onto a chiller wheel 38, which may convert the molten metal 30 into metal flakes 46.

The main chamber 28 and the tower 10 of the present invention may be suspended within an inert gas chamber 16. The inert gas chamber 16 may create an oxygen free environment. However, a hard vacuum may work as well instead of the inert gas chamber 16. The inert gas chamber 16 may suspend the present invention in an argon atmosphere, which is heavier than oxygen and thereby excludes the oxygen from the casting process.

In certain embodiments, the present invention may include an alloy furnace 12. The alloy furnace 12 may melt the alloy and maintain the temperature within the main chamber 28. The size of the furnace 12 may be any size desired. The alloy furnace 12 may maintain a temperature so that the alloy flow is sufficient to keep the alloy mixed without hot spots.

In certain embodiments, the present invention may further include a plurality of chambers. For example, the present invention may include a molten rare earth element chamber 22 which contains molten rare earth elements 24. The present invention may include a molten iron chamber 18 which may contain molten iron 20. The present invention may include a static mixer 26 which may feed from the chambers 18, 22 into the main chamber 28. The static mixer 26 may mix the molten rare earth elements 24 and the molten iron 20 and deposit the mixture into the main chamber 28. The static mixer 26 may mix the molten rare earth elements 24 and molten iron 20 by using gravity. The furnace 12 may be apply heat to the chambers 18, 22 to melt the molten iron 20 and the molten rare earth elements 24 into their molten state.

The molten iron 20 and the molten rare earth elements 24 are mixed into the alloy mixture 30 and are contained within the main chamber 28. The pump 32 may pump the alloy mixture 30 into the tower 10, which creates a flowing column of molten alloy 30 within the tower 10. The pump 30 may be any appropriate pump, such as but not limited to, an auger pump 50 and a gear pump 54. A gear pump 54 may be connected to a gear pump motor 56. The molten alloy 30 may be pumped through the tower module port 42 and up the tower 10.

Once the molten alloy 30 has been pumped through the tower 10, the molten alloy 30 is directed to the upper pool chamber 34. In certain embodiments, the upper pool chamber 34 may include an overflow nozzle 52. The overflow nozzle 52 may direct any overflowing alloy 30 back to the main chamber 28. A feeder nozzle 36 may be attached to the upper pool chamber 34 and may direct the alloy 30 to a chiller wheel 38. The chiller wheel 38 may cool down the molten alloy into metal flakes 46 and may be directed to a product collector 48 for collection. In certain embodiments, the metal flakes 46 may be the magnetic flakes used to make bonded and full density magnets. Alloy ingots may also be produced by tolling one of the interchangeable casting assemblies to fill molds to make the ingots.

Figure 2:
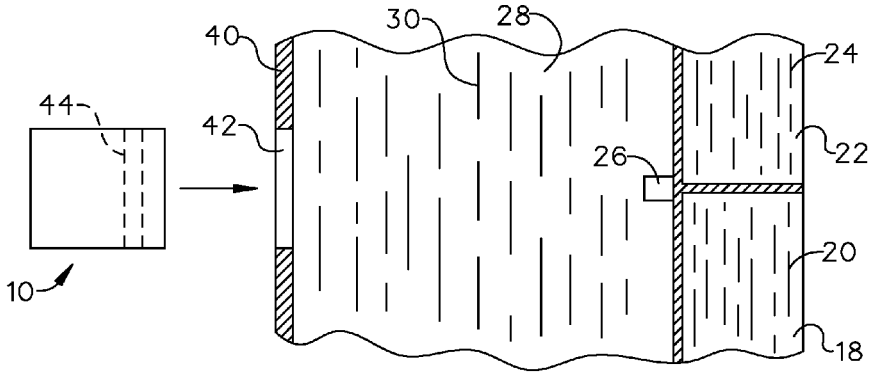
FIG. 2 is a detail top schematic view of the present invention, illustrating the placement of the tower onto the main chamber of FIG. 1.
Figure 3:
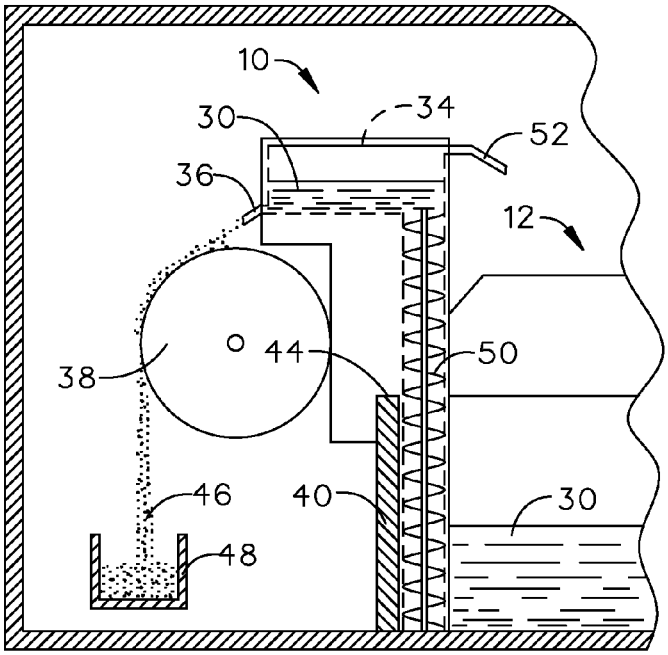
FIG. 3 is a schematic view of an alternate embodiment of the present invention.
Figure 4:
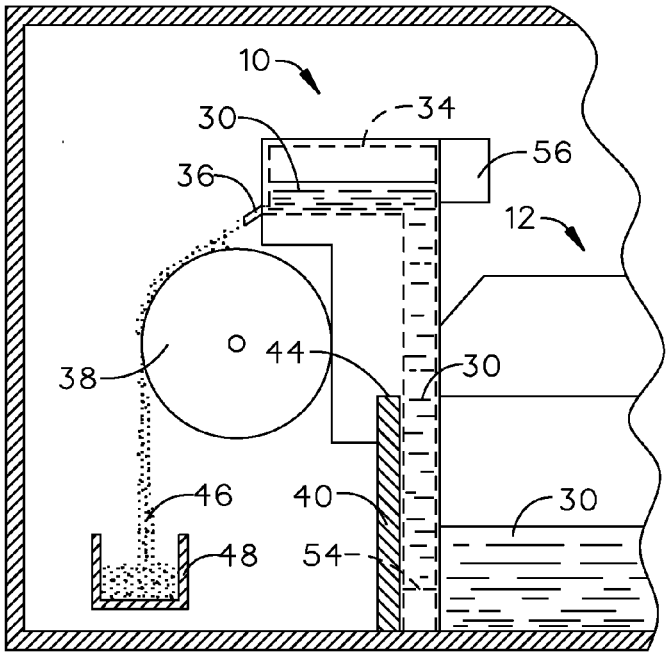
FIG. 4 is a schematic view of an alternate embodiment of the present invention.

In certain embodiments, the tower 10 may be removable from the furnace wall 40 of the furnace 12 or chamber 28. As illustrated in FIG. 2, the bottom end of the tower 10 may include a mounting slot 44. The mounting slot 44 may fit into the tower module port 42 of the furnace 12 or chamber 28. Therefore, the tower 10 may be easily removed and maintenance may be easily performed. The molten alloy 30 may flow through the module port 42 and through the mounting slot into the tower 10.

Figure 5:
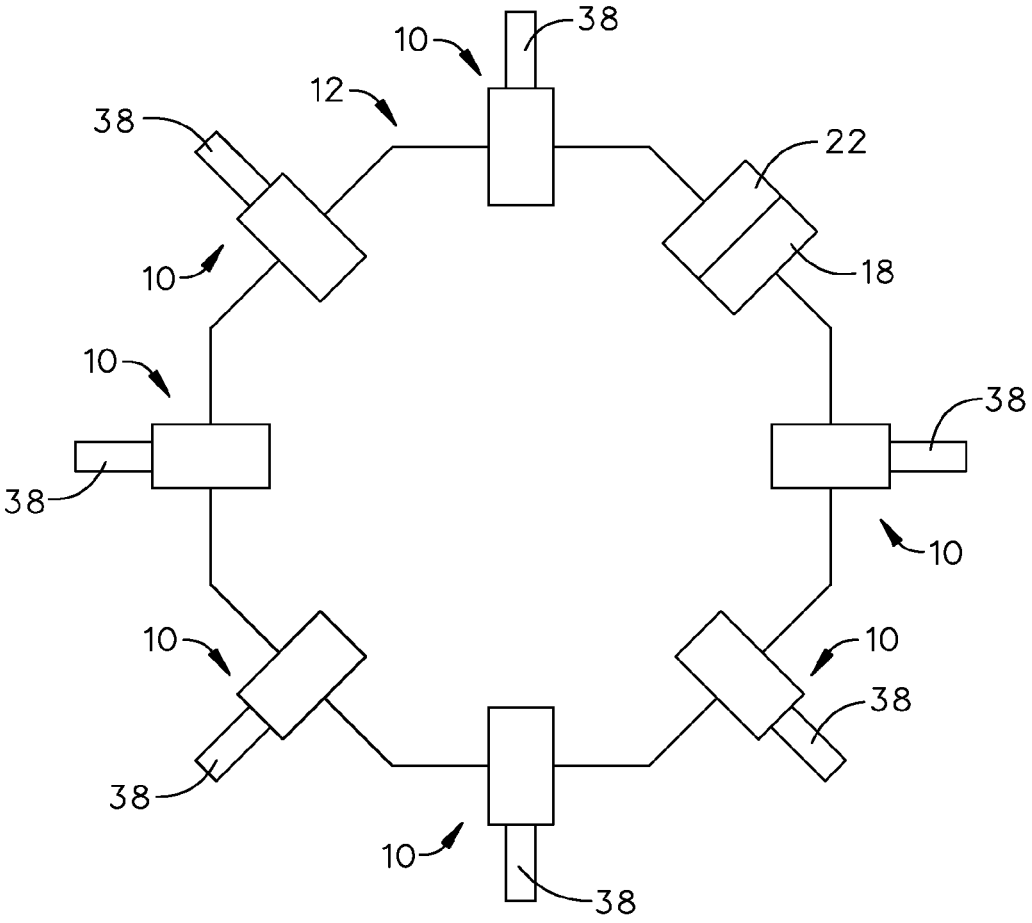
FIG. 5 is a schematic view of a plurality of towers attached to the main chamber of FIG. 1.

A plurality of towers 10 may be attached to a single furnace 12, as illustrated in FIG. 5. Since all of the towers 10 may include interchangeable parts, repairing the towers 10 may be quicker and easier. Further, if towers 10 need to be repaired, other towers 10 may continue to cast and the process becomes continuous. As illustrated in FIG. 5, the single furnace 12 may include an input, which may include the molten rare earth element chamber, and the molten iron chamber. The molten iron and rare earth elements may be mixed and may enter into the furnace 12.

The jet casting process may be restricted by the chillers ability to chill the alloy at the critical rate. Therefore the flow is effectively fixed at a small amount for chilled product. However, the melting and alloy furnace may be larger in scale to be efficient. The present invention may be used to deliver a relatively small, but constant amount to the chiller. Each caster may be fed from single furnace. There may be as many different product configurations as there are ports on the furnace and the furnace melt capacity.

It should be understood, of course, that the foregoing relates to exemplary embodiments of the invention and that modifications may be made without departing from the spirit and scope of the invention as set forth in the following claims.

What is claimed is:

1. A casting apparatus comprising:

a main chamber comprising a wall formed to contain a molten metal;

at least one tower having a top end and a bottom end and comprising an upper pool chamber near the top end, and a mounting slot;

a pump configured to pump the molten metal through the tower to the upper pool chamber;

a feeder nozzle connected to the upper pool chamber, and configured to dispense the molten metal out of the upper pool chamber, wherein the at least one tower is removably attached to the wall by the mounting slot and disposed so that the bottom end of the at least one tower is within the main chamber.

2. The casting apparatus of claim 1, further comprising a chiller wheel, wherein the feeder nozzle is configured to direct the molten metal from the upper pool chamber to the chiller wheel, and wherein the chiller wheel is configured to turn the molten metal into metal flakes.

3. The casting apparatus of claim 1, wherein the molten metal is a molten alloy.

4. The casting apparatus of claim 3, further comprising an alloy furnace, wherein the main chamber is within the alloy furnace.

5. The casting apparatus of claim 4, further comprising an inert gas chamber, wherein the tower, the main chamber, and the alloy furnace are contained within the inert gas chamber.

6. The casting apparatus of claim 1, further comprising a plurality of towers removably attached to the wall of the main chamber.

7. The casting apparatus of claim 1, further comprising:

a molten rare earth element chamber;

a molten iron chamber; and a static mixer, wherein the molten rare earth element chamber is formed to contain a molten rare earth element, and the molten iron chamber is formed to contain a molten iron, wherein the static mixer is configured to mix the molten rare earth element and the molten iron into a molten metal alloy mixture and disperse the mixture to the main chamber.

8. The casting apparatus of claim 1, further comprising a product collector, wherein the chiller wheel is configured to feed the metal flakes into the product collector.

9. The casting apparatus of claim 1, further comprising an overflow nozzle attached to the upper pool chamber, wherein the overflow nozzle is configured to direct excess molten metal back into the main chamber.

10. The casting apparatus of claim 1, wherein the pump is at least one of a gear pump and an auger pump.

11. The casting apparatus of claim 1, wherein the mounting slot is formed in the at least one tower.

12. The casting apparatus of claim 11, wherein at least one tower module port is formed on the wall, wherein the mounting slot is configured to receive the tower module port and removably secure the tower to the main chamber.

13. The casting apparatus of claim 6, wherein the mounting slot is formed in each of the plurality of towers.

14. The casting apparatus of claim 13, wherein a plurality of tower module ports are formed on the wall, wherein the mounting slots of each tower is configured to receive the tower module port and removably secure the tower to the main chamber.

15. The casting apparatus of claim 6, wherein a pump is within each of the plurality of towers.

16. A casting apparatus comprising:

a main chamber formed to contain a molten metal;

a tower having a top end and a bottom end and comprising an upper pool chamber near the top end, wherein the main chamber feeds into the tower;

a pump configured to pump the molten metal from the bottom end of the tower to the upper pool chamber;

a feeder nozzle connected to the upper pool chamber, and configured to dispense the molten metal out of the upper pool chamber;

a molten rare earth element chamber;

a molten iron chamber; and a static mixer, wherein the molten rare earth element chamber is formed to contain a molten rare earth element, and the molten iron chamber is formed to contain a molten iron, wherein the static mixer is configured to mix the molten rare earth element and the molten iron into a molten metal alloy mixture and disperse the mixture to the main chamber.

* * * * *